US007160115B2

(12) United States Patent
Huang et al.

(10) Patent No.: US 7,160,115 B2
(45) Date of Patent: Jan. 9, 2007

(54) CONTACT MODULE WITH CONNECTORS

(75) Inventors: Yao-Chi Huang, Tu-Chen (TW); Nick Lin, Tu-Chen (TW); Jeffrey Hsieh, Tu-Chen (TW); Fang-Jwu Liao, Tu-Chen (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 11/060,118

(22) Filed: Feb. 16, 2005

(65) Prior Publication Data

US 2006/0024987 A1 Feb. 2, 2006

(30) Foreign Application Priority Data

Aug. 2, 2004 (TW) ..... 93212206 U

(51) Int. Cl.
*H01R 12/00* (2006.01)

(52) U.S. Cl. ..... 439/66

(58) Field of Classification Search ..... 439/66, 439/71, 862, 591, 91

See application file for complete search history.

(56) References Cited

U.S. PATENT DOCUMENTS 4,699,593 A 10/1987 Grabbe
4,906,194 A 3/1990 Grabbe
4,927,369 A 5/1990 Grabbe
5,308,252 A * 5/1994 Mroczkowski et al. ..... 439/66
5,380,210 A 1/1995 Grabbe
5,462,440 A * 10/1995 Rothenberger ..... 439/66
5,573,435 A 11/1996 Grabbe
5,653,598 A 8/1997 Grabbe
5,913,687 A * 6/1999 Rathburn ..... 439/66
6,193,523 B1 2/2001 Harper
6,694,609 B1 2/2004 Lopata
6,758,702 B1 * 7/2004 Johnescu ..... 439/862

OTHER PUBLICATIONS

Marks' Standard Handbook for Mechanical Engineers, 9th ED, McGraw-Hill, section 3-9.*

* cited by examiner

*Primary Examiner*—Alexander Gilman
(74) *Attorney, Agent, or Firm*—Wei Te Chung

(57) ABSTRACT

A contact module with connectors adapted to engage with first and second electrical conductors such that when resiliently interfaced with the conductors there is a net zero moment of inertia exerted on the conductors. Each individual connector exerts a resilient spring force to engage with an electrical conductor. When such resilient forces, as in the prior art are aggregated, they can exert a considerable vectored moment of inertia on the electrical conductors to which they are connected. The connectors of the present invention are arranged so that each individual connector has an opposing connector somewhere in the module to offset each individual moment of inertia so that the net sum of all moments on the interfacing electrical conductor is zero.

7 Claims, 11 Drawing Sheets

CONTACT MODULE WITH CONNECTORS

1. CROSS-REFERENCE TO RELATED APPLICATIONS

This application claims priority from the filing of Taiwan application 093212206 filed Aug. 2, 2004.

2. BACKGROUND OF THE INVENTION

The field of endeavor of this Contact Module with Connectors is, generally, Class 439, Sub-class 66, relating to a contact module that is compressible and to be sandwiched between panel circuits. The invention relates to the elimination of a net moment of inertia on when the contacts of the module are resiliently interfaced with electrical conductors.

The materials set forth in connection with this U.S. patent application describe a contact module with connectors. Further description of this invention is set forth below and in the attached drawings (FIGS. 1–10).

3. BRIEF SUMMARY OF THE INVENTION

This invention relates to a new arrangement of the plurality of individual connectors in a contact module such that when each individual connector is resiliently interfaced with an electrical conductor, there is an opposite facing individual connector such that the net moment of inertia exerted on the electrical conductor is zero. The individual connectors need not be individually paired with an opposite facing connector so long as the total number of connectors facing in one direction are balanced by the same number of connectors facing in the opposite direction so that the net moment of inertia exerted on the conductor is zero.

4. BRIEF DESCRIPTION OF THE DRAWINGS

FIG. 1 depicts a view generally from the side and top of the contact module having a plurality of resilient, generally C-shaped connectors arranged in alternating rows such that the connectors in each row have an open end facing in a first direction and, further, such that the connectors in an adjacent row have an open end facing in a second, opposite direction such that the number of connectors facing in the first direction has a counterpart connector facing in the second, opposite direction. The connectors fit within the module to resiliently interface with electrical conductors.

5. DETAILED DESCRIPTION OF THE INVENTION

The present invention pertains to contact modules with a plurality of connectors, primarily with respect to Land Grid Array ("LGA") connectors and Ball Grid Array ("BGA") connectors. LGA and BGA connectors are well known in the art, see, e.g. U.S. Pat. Nos. 5,308,252 and 6,024,584, respectively. To achieve high integrity data communications between an outside source of data and a device, connectors have been designed to accommodate high density contact so that increased data flow through the connector can be achieved. However, connectors with a resilient interfacing force in BGAs and LGAs in the prior art have been oriented in the same direction. The resilient interfacing pressure of each individual connector exerts a small force which can be measured in dynes on the interfacing electrical conductor. The connectors comprise a spring bias means for providing an amount of spring bias to the electrical conductor. The total force exerted on the interfacing electrical conductor and, therefore, also on the connector itself, by means of the resilient spring bias is cumulative as a vector quantity and this force can be considerable when there are several hundred connectors in a single module exerting a net moment of inertia at the conductor interface in the same direction.

It is an object of the invention to remove a net moment of inertia on the interfacing electrical conductor, and hence, on the connector, itself by positioning the connectors within the housing module such that for each connector facing in a given direction, there is, somewhere on the module, a connector facing in the opposite direction so that the net moment of inertia from the resilient pressure of the connector exerted on the conductor is zero.

It is a further object of the invention to achieve a net moment of inertia of zero from the resilient pressure of the connector exerted on the conductor, but, in such a manner that opposing connectors are not arranged as opposing pairs of connectors.

Applicants have discovered a means of eliminating the moment of inertia exerted by the resilient spring bias force by placing the individual connectors within the module so that regardless of the directional orientation of the individual connectors, for each connector facing in one direction, there will be another connector within the module facing in the opposite direction.

Figure 1:
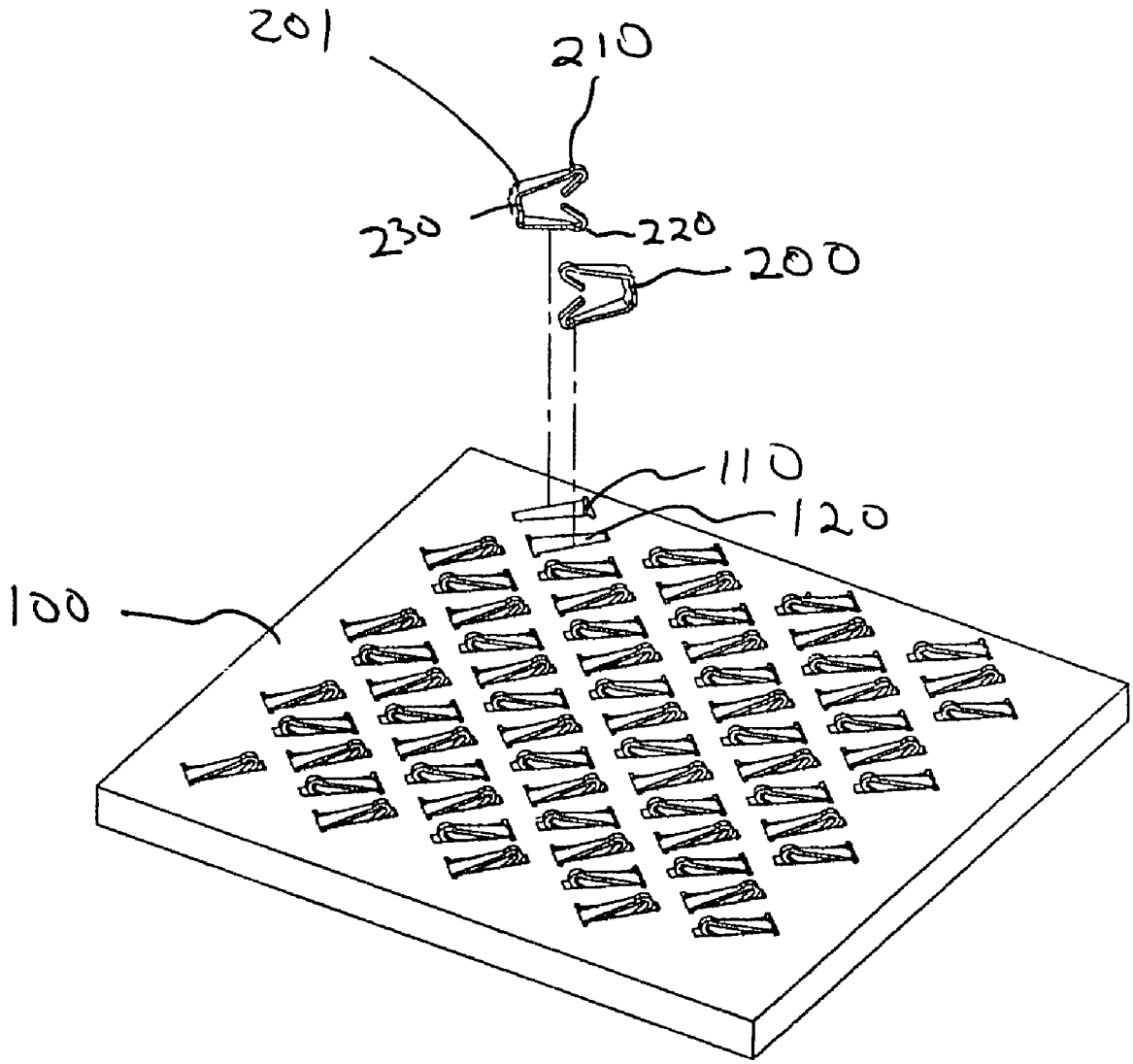
Figure 2:
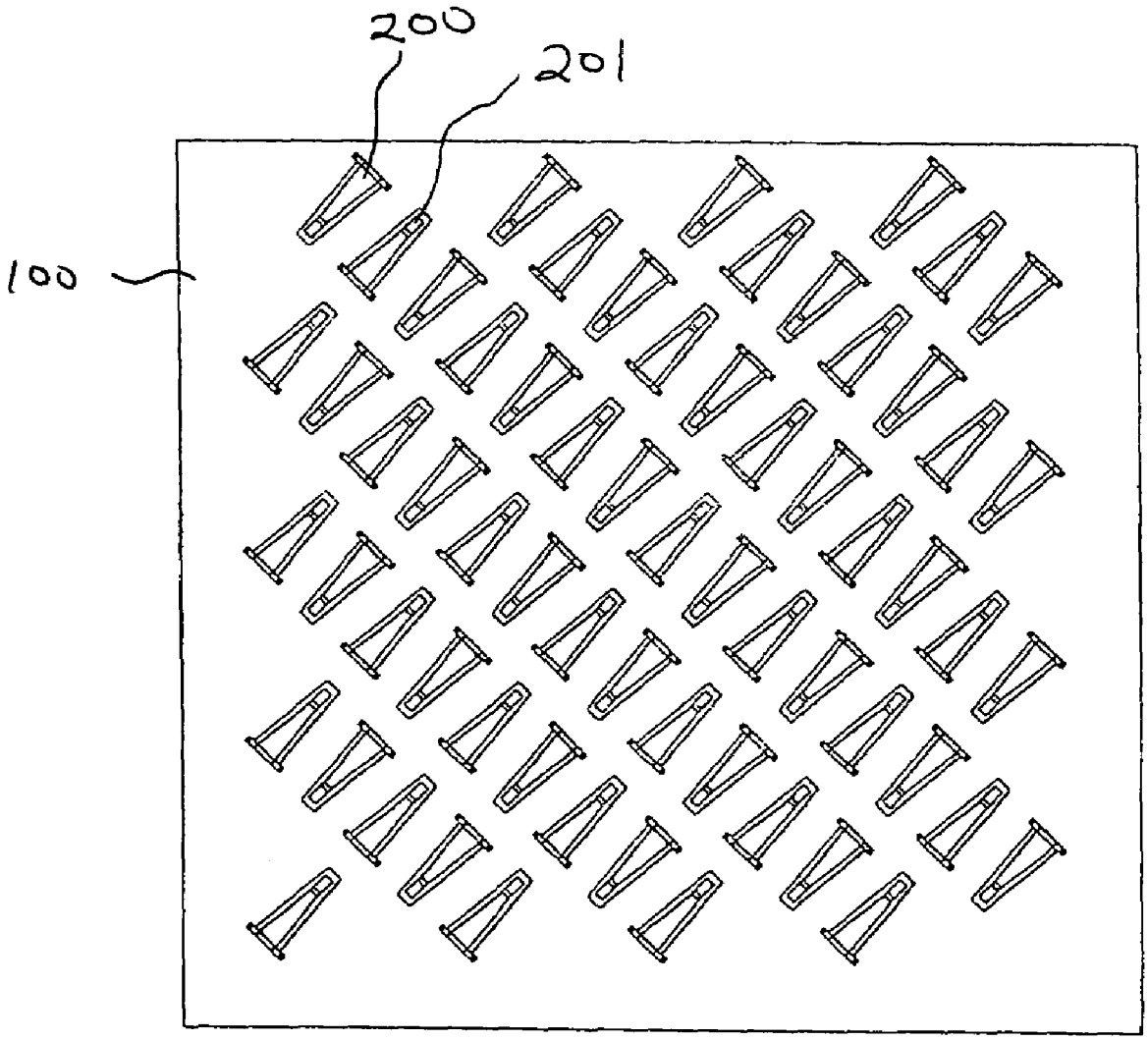
FIG. 2 depicts the contact module of FIG. 1 from above.
Figure 3:
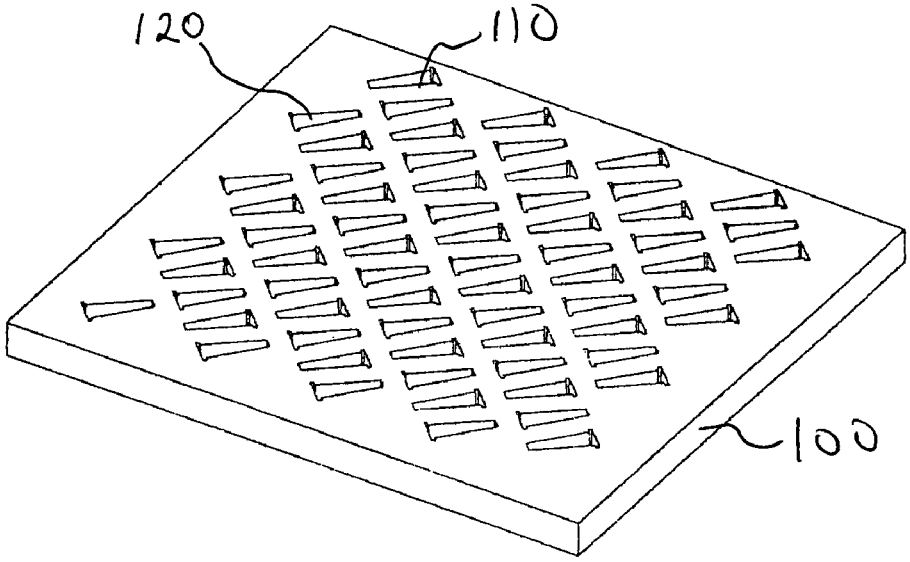
FIG. 3 depicts the contact module of FIG. 1 showing the holes in the module housing without the individual contacts.

Referring to FIGS. 1 and 2, the housing module 100 has arranged within it, a plurality of resilient, generally C-shaped connectors, 200, having an upper connector portion, 210, and a lower connector portion, 220, arranged in alternating rows such that the connectors in each row have an open end facing in a first direction and, further, such that the connectors in an adjacent row have an open end facing in a second, opposite direction such that the number of connectors facing in the first direction has a counterpart connector facing in the second, opposite direction. The connector 200 is attached within the module at the connector vertical support portion, 230, so that the upper and lower connector portions, 210 and 220, respectively, can resiliently interface with electrical conductors. FIGS. 1 and 2 show the opposing orientation of connector 200 facing in a first direction and connector 201 facing in a direction opposite the first direction. FIG. 3 shows the opposing orientation of connector holes 110 and 120.

Figure 4:
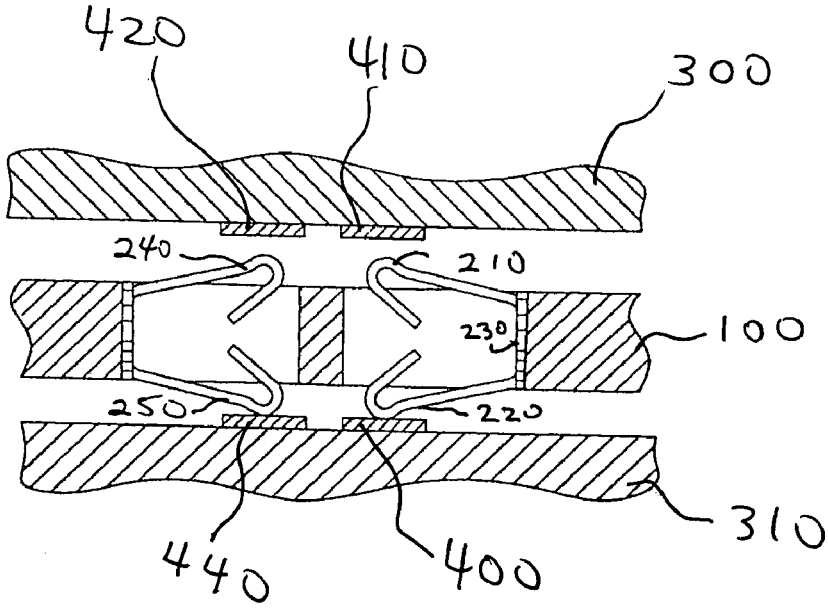
FIG. 4 is a side view depicting a portion of the contact module with a pair of opposing connectors such that the lower portion of the connector is resiliently interfaced with pads on a lower electrical conductor. The upper portion of the connector has not been interfaced with an upper electrical conductor.
Figure 5:
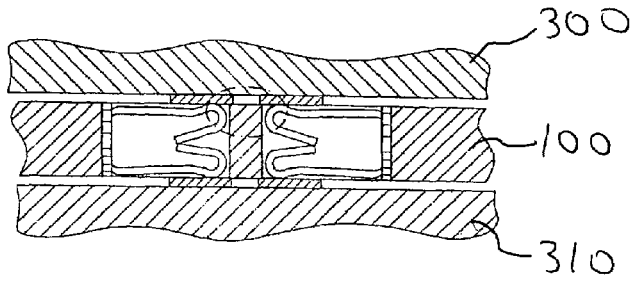
FIG. 5 is a side view depicting generally the view of FIG. 4, with resilient interfacing between the upper and lower connector portion and an upper and lower electrical conductor.
Figure 6:
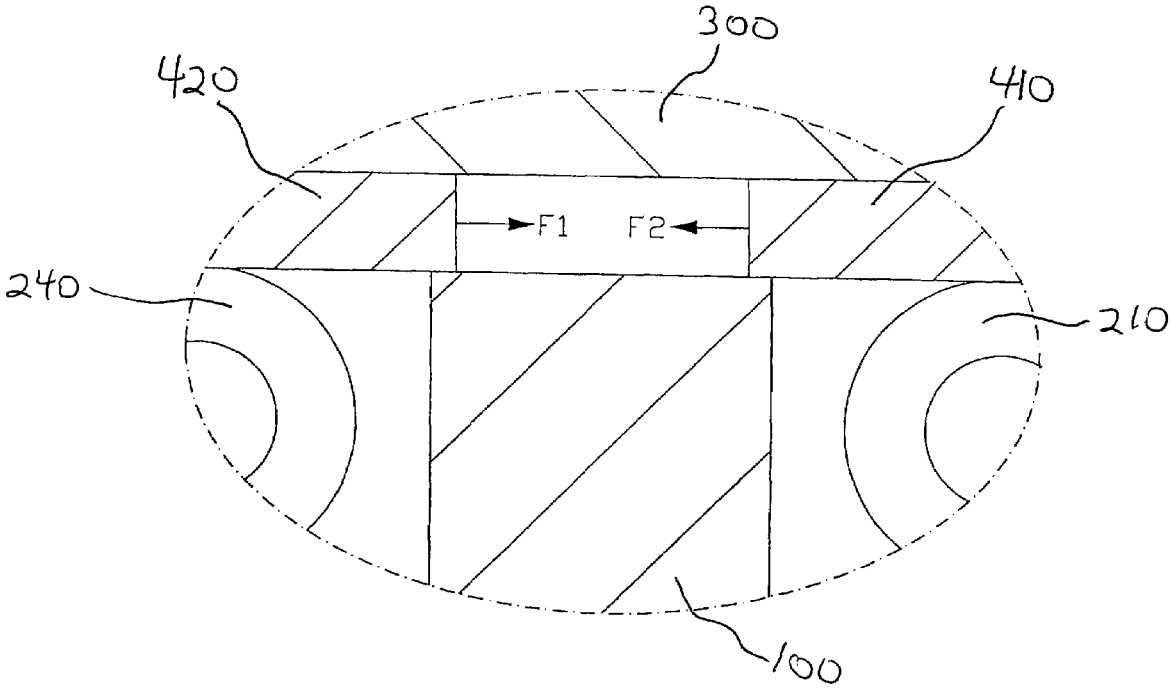
FIG. 6 is an enlargement of a section of FIG. 5 depicting the resilient contact of the upper connector portion with the pads of the upper electrical conductor and further showing the counterbalanced moment of inertia exerted by the opposing connectors onto the pads of the upper electrical conductor.

Referring to FIGS. 4, 5 and 6, these show the lower connector portions 220 and 250 resiliently interfaced with pads 400 and 440 of lower electrical conductor 310. FIG. 4 depicts only the lower portion resiliently interfaced, whereas FIG. 5 depicts the lower connector portions engaged as in FIG. 4, but, also the upper connector portions, 210 and 240 resiliently interfaced with the pads 410 and 420, respectively of upper electrical conductor 300. FIG. 6 is an enlarged view of that section of FIG. 5 showing the interfacing of the upper connector portions 210 and 240 with pads 410 and 420 of conductor 300. Upper connector portion 240 exerts a resilient spring force moment of inertia on pad 420 depicted as F1, whereas, upper connector portion 210 exerts a resilient spring force moment of inertia on pad 410 depicted as F2. F1 and F2 are equal opposing forces which result in a net moment of zero on the electrical conductor 300.

Figure 7:
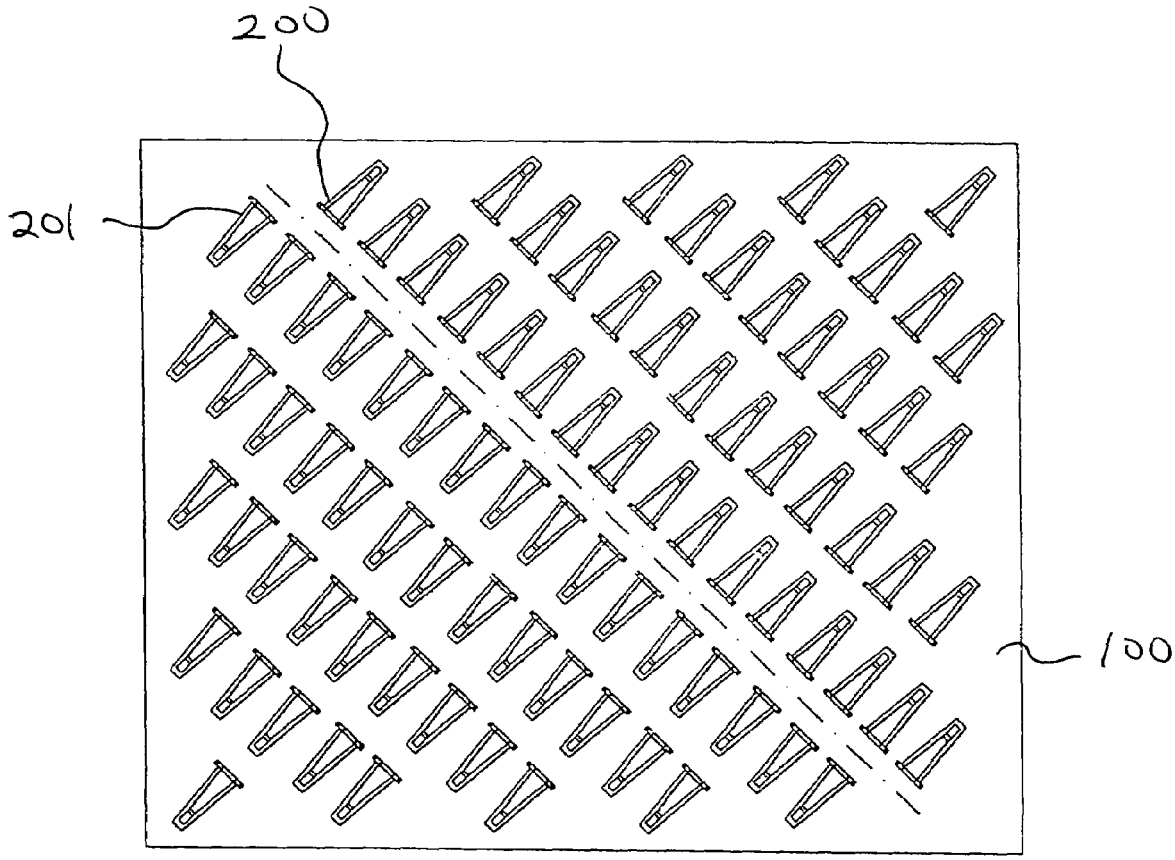
FIG. 7 depicts a contact module from above with the individual connectors arranged on the module such that on one side of a generally bisecting diagonal line of the module, half of the connectors face in one direction away from the center of the module and the other half of the connectors on the other side of the diagonal line face in an opposing direction.
Figure 8:
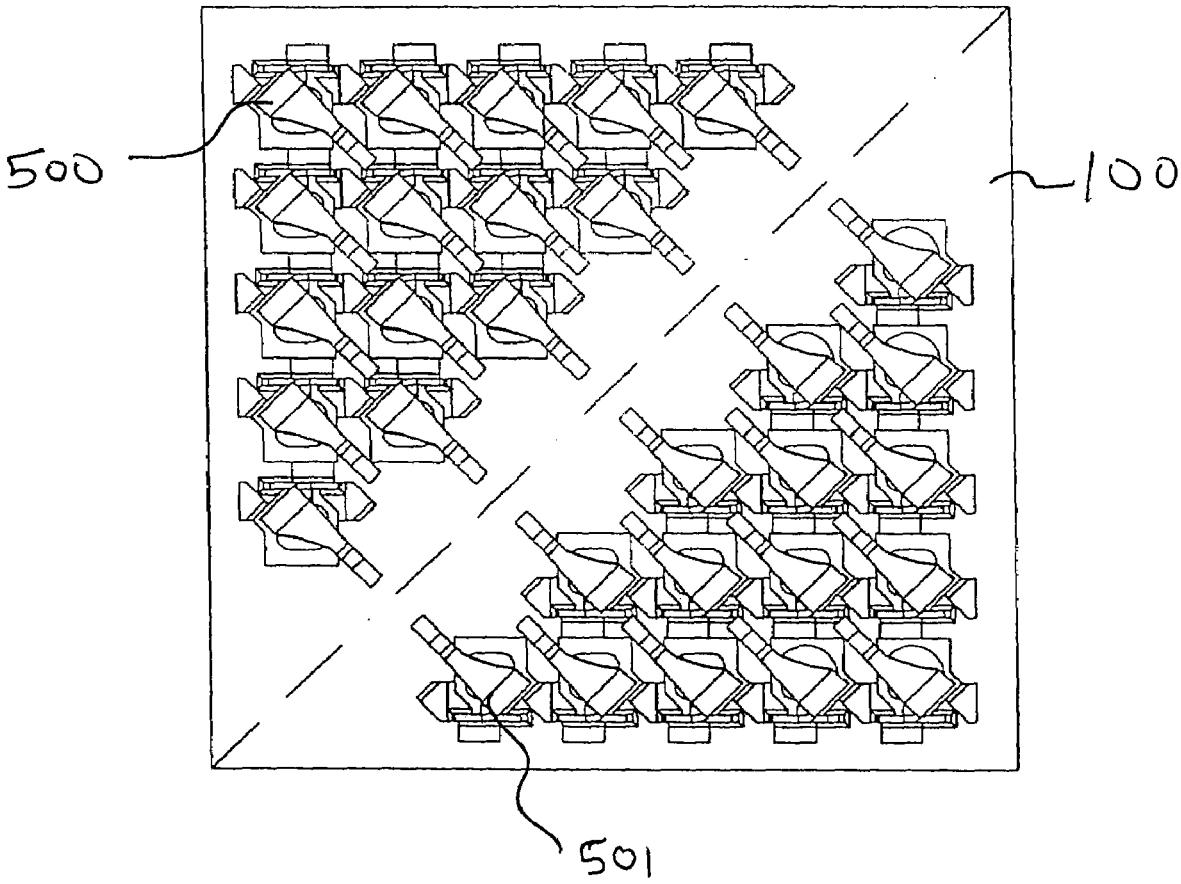
FIG. 8 is a view from above depicting a bisecting diagonal line on the module, such that on one side of the diagonal line, half of the connectors face in one direction towards the center of the module, and the other half of the connectors on the other side of the diagonal line face in an opposing direction.

FIG. 7 depicts an embodiment whereby the connectors are arranged with respect to a generally diagonal line on the module 100 such that those connectors 200 on one side of the diagonal face away from the diagonal and those connectors 201 on the other side of the diagonal face away from the diagonal in the opposite direction. FIG. 8 depicts a similar orientation to FIG. 7, except that the connectors are facing inward toward the diagonal line.

Figure 9:
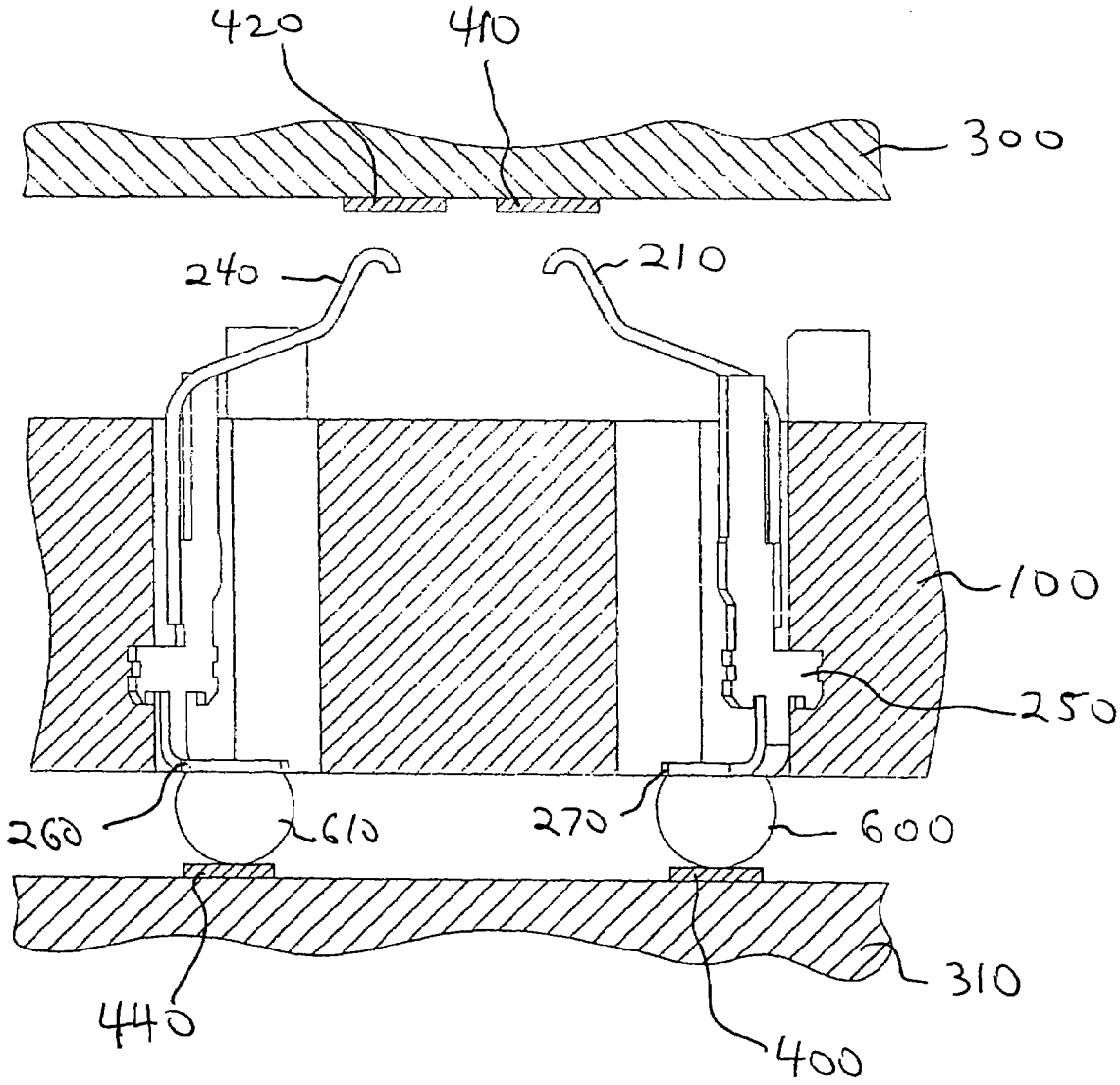
FIG. 9 is a side view of the module depicting opposing connectors such that the lower portion of the connector has a solder ball attached which makes electrical contact with the pad on the lower electrical conductor, while the upper portion of the connector has not yet made resilient contacting interface with the upper electrical conductor.
Figure 10:
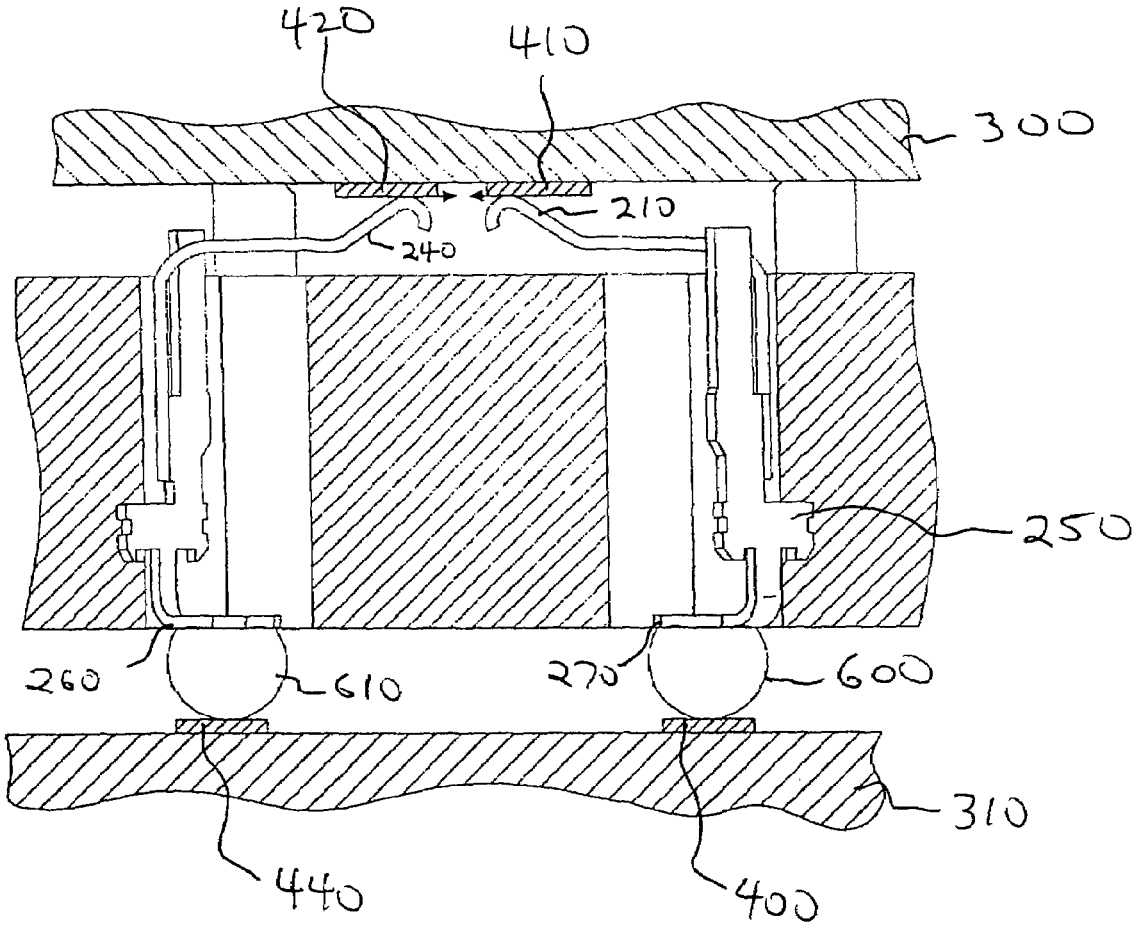
FIG. 10 depicts the view of FIG. 9 such that the upper contact portions are resiliently interfaced with the pads on the upper electrical conductor and further showing the counterbalanced moment of inertia exerted by the opposing connectors onto the pads of the upper electrical conductor.
Figure 11:
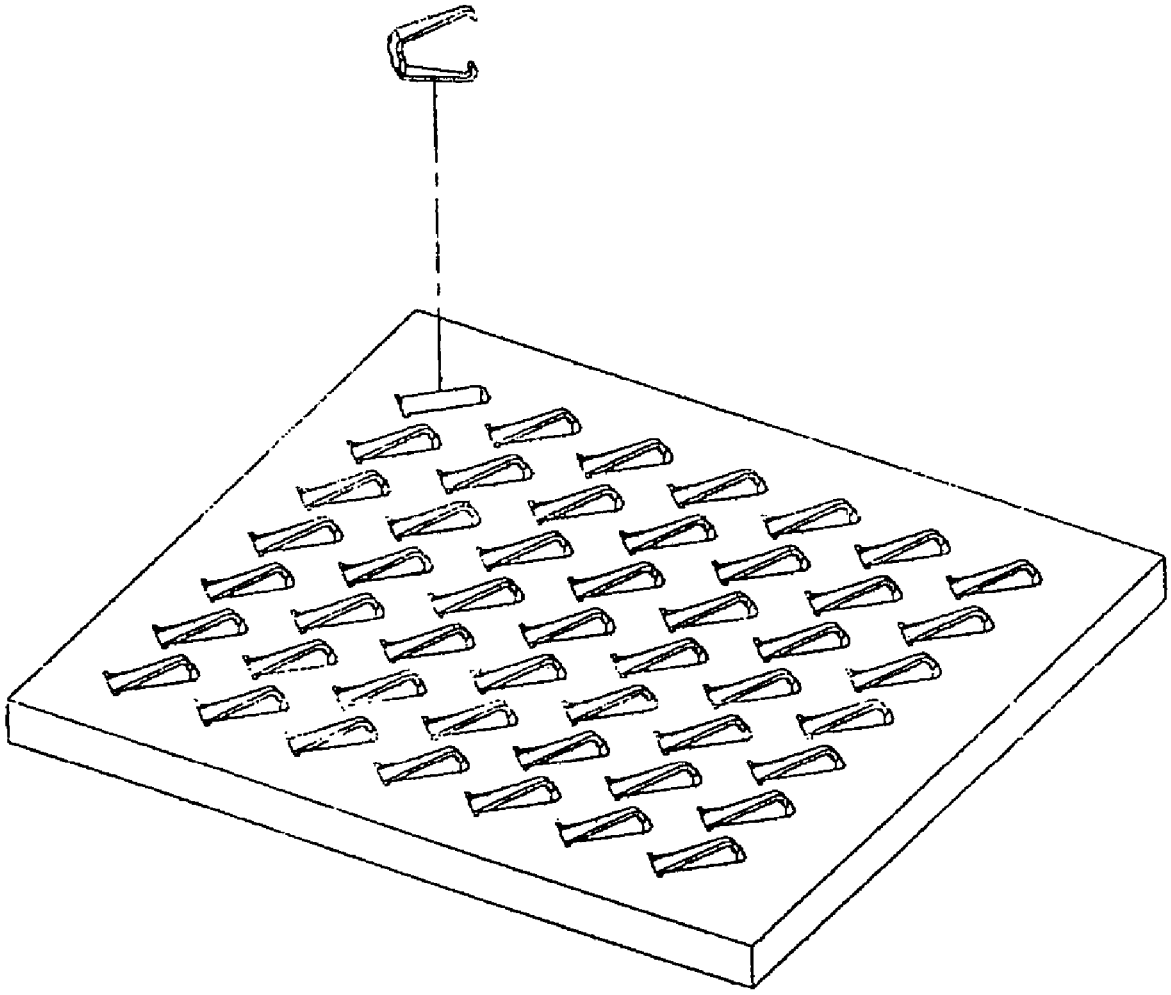
FIG. 11 (PRIOR ART)
FIG. 11 depicts the prior art showing a view generally from the side and top of the contact module having a plurality of resilient, generally C-shaped connectors arranged in rows such that all of the connectors have an open end facing in the same direction.
Figure 12:
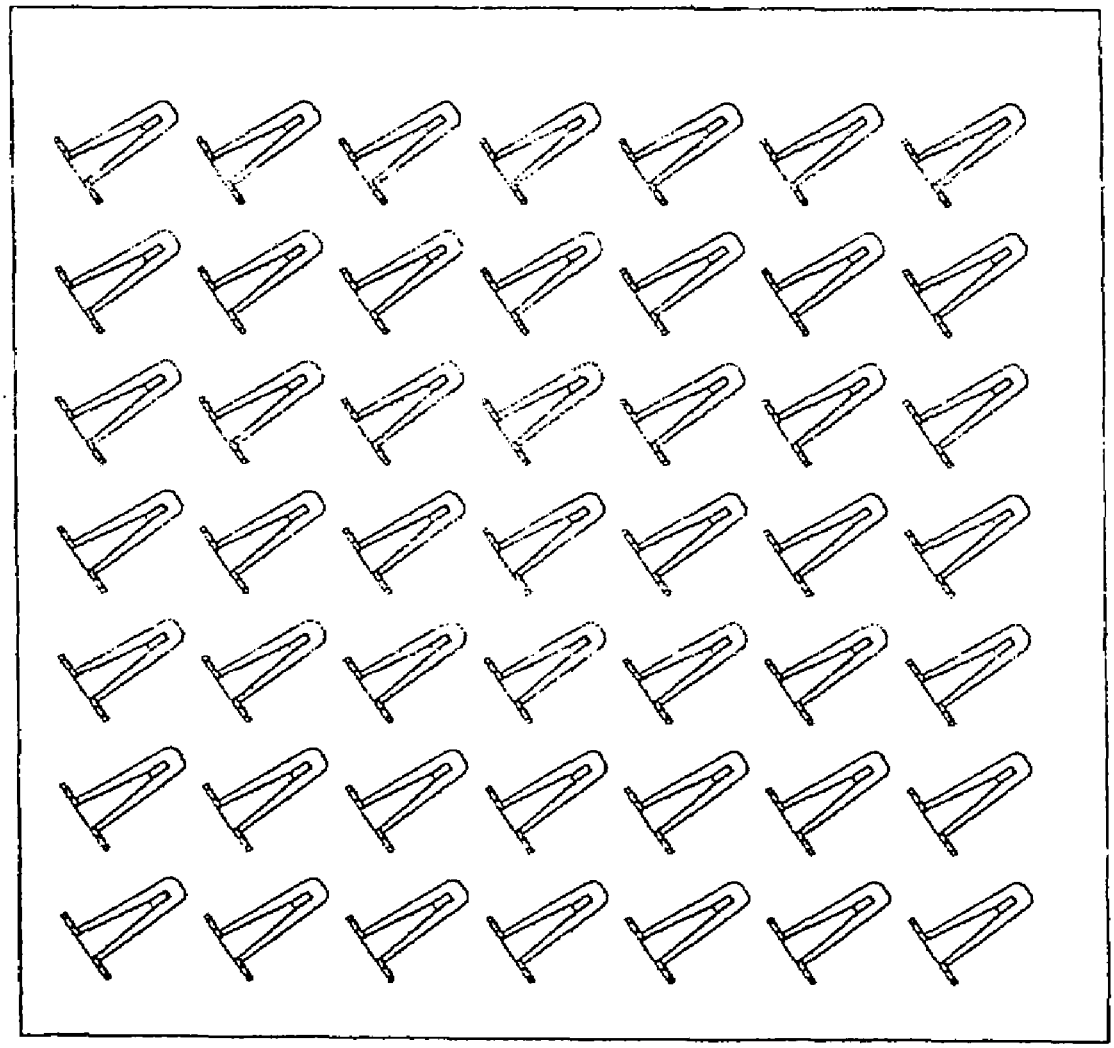
FIG. 12 (PRIOR ART)
FIG. 12 depicts the prior art shown in FIG. 11 from above.
Figure 13:
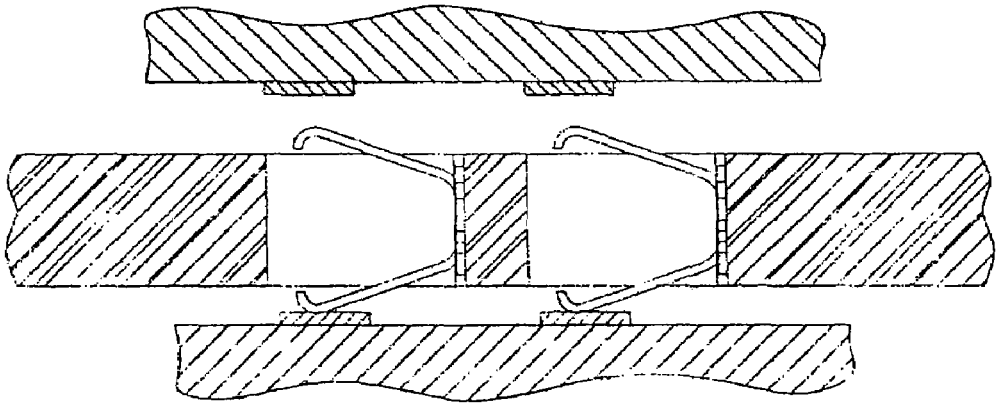
FIG. 13 (PRIOR ART)
FIG. 13 is a side view of the prior art depicting a portion of the contact module with a pair of same direction-facing connectors such that the lower portion of the connector is resiliently interfaced with pads on a lower electrical conductor. The upper portion of the connector has not been interfaced with an upper electrical conductor.

FIGS. 9 and 10 depict the connector such that the lower portion of the connector is not resiliently interfaced with a conductor, but, rather lower connector portions 260 and 270 are respectively attached to solder balls 610 and 600, which, in turn, are electrically connected to pads 440 and 400 of lower conductor 310. FIG. 9 depicts the upper connector portions 240 and 210 not in interfacing engagement with pads 420 and 410 of upper conductor 300. The opposing connectors are secured in the module housing by retaining structure 250. FIG. 10 depicts the upper connector portions 240 and 210 in resilient interfacing engagement with pads 420 and 410 of upper conductor 300 and Force arrows depict the opposing moment of inertia forces canceling each other.

Figure 14:
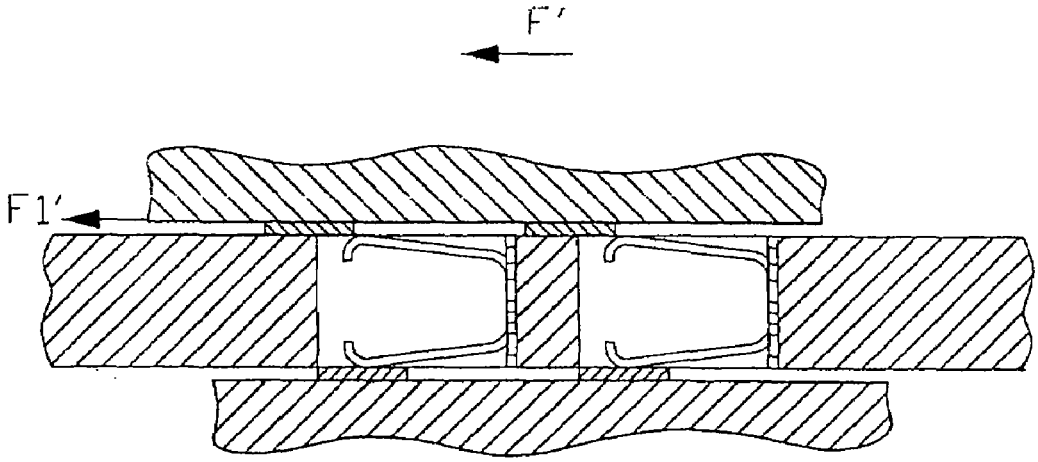
FIG. 14 (PRIOR ART)
FIG. 14 is a side view of the prior art depicting generally the view of FIG. 13, with resilient interfacing between the upper and lower connector portion and an upper and lower electrical conductor, further showing a net moment of inertia force exerted on the upper electrical conductor.

FIG. 11–14 depict the prior art which shows each of the connectors having only one orientation in the module. FIG. 14 depicts a vectored net moment of inertia exerted on the segment shown of an upper electrical conductor, F1', and a total net moment exerted on the entire conductor, F'.

It will be appreciated by those skilled in the art that the connectors can be oriented individually in any direction within the module so long as somewhere on the module there is a counterpart connector facing in the opposite direction. The connectors need not be paired in close proximity. With such an arrangement, the net moment of inertia on the conductor will be zero. Thus the connectors, conductors and contact module as described and claimed in accordance with the present invention ensure high integrity contact surface interfaces with a net zero moment of inertia exerted on the conductor. Furthermore, the present invention provides connectors and contact modules which are high cycle-life and reliable.

There have thus been described certain embodiments of connectors with respect to the module provided in accordance with the present invention. While preferred embodiments have been described and disclosed, it will be recognized by those with skill in the art that modifications are within the true spirit and scope of the invention. The appended claims are intended to cover all such modifications. For example, an alternate embodiment may disclose the contact portions extend in opposite directions between two neighboring terminals in each line defined along the contact portion extension direction so that the contact portions of the whole matrix type terminals result in an alternate manner in both the lengthwise direction and the transverse direction in comparison with the first embodiment showing the alternate arrangement only along the transverse direction while the same arrangement along the lengthwise direction.

What is claimed is:

1. An electrical assembly comprising:

a plate having a plurality of conductive pads on an undersurface thereof a rectangular insulative housing located under said plate;

a plurality of defiectively resilient terminals retainably disposed in the housing, each of said terminals defining an upper contact portion exposed above an upper face of the housing and downwardly deflectably engaged with the corresponding conductive pad when the plate and the housing are coupled to each other, some of said terminals having first portions, exclusive of second portions, defining corresponding upper contact portions while the remaining of said terminals having said second portions, exclusive of said first portions, defining corresponding upper contact portions, wherein downward deflection of the contact portion results in a horizontal resistant force component relative to the plate according to an extension direction of said contact portion from a top view of the housing, and the contact portions of said first portions of the terminals direct to a first extension direction while those of said second portions of to terminals direct to a second direction opposite to said first direction so as to counterbalance total horizontal resistant force components derived from said first portions and said second portions of the terminals, thus assuring said plate will not tend to move horizontally due to any horizontal resistant force components derived from the first portions and the second portions of the terminals;

wherein the first portions and the second portions are located by two sides of an imaginary center line which is perpendicular to said first and second direction wherein said center line is essentially diagonal with regard to the housing.

2. An electrical assembly comprising:

a plate having a plurality of conductive pads on an undersurface thereof a rectangular insulative housing located under said plate;

a plurality of deflectively resilient terminals retainably disposed in the housing, each of said terminals defining an upper contact portion exposed above an upper face of the housing and downwardly deflectably engaged with the corresponding conductive pad when the plate and the housing are coupled to each other, some of said terminals having first portions, exclusive of second portions, defining corresponding upper contact portions while the remaining of said terminals having said second portions, exclusive of said first portions, defining corresponding upper contact portions, wherein downward deflection of the contact portion results in a horizontal resistant force component relative to the plate according to an extension direction of said contact portion from a top view of the housing, and the contact portions of said first portions of the terminals direct to a first extension direction while those of said second portions of the terminals direct to a second direction opposite to said first direction so as to counterbalance total horizontal resistant force components derived from said first portions and said second portions of the terminals, thus assuring said plate will not tend to move horizontally due to any horizontal resistant force components derived from the first portions and the second portions of the terminals, wherein said housing defines a plurality of passageways to receive the corresponding terminals therein, respectively, wherein each of said passageways is not an even rectangular manner and every two neighboring passageways are complementary to each other in a third direction perpendicular to said first and second directions.

3. The electrical assembly as claimed in claim 2, wherein the first portions and the second portions are located by two sides of an imaginary center line which is perpendicular to said first and second direction wherein said center line is essentially diagonal with regard to the housing.

4. The electrical assembly as claimed in claim 2, wherein each of said first portion and said second portion of terminals occupies a triangular area on the housing from a top view.

5. The electrical assembly as claimed in claim 2, wherein the first direction and the second direction are essentially diagonal with regard to the housing.

6. The electrical assembly as claimed in claim 2, wherein the terminals are arranged in at least two rows and at least two columns perpendicular to each other, under a condition that the first and the second directions extend along said columns, and the terminals having the first portions thereof are aligned with one another in said columns and also in said rows, and the terminals having the second portions thereof are aligned with one another in said columns and also in said rows, while the terminals having the first portions are arranged in a first area and the terminals having the second portions are arranged in a second area not intermingled with said first area; wherein said first area and said second area are essentially of triangle configuration and separated from each other by an imaginary line along a diagonal direction of said housing.

7. An electrical assembly comprising:

a plate having a plurality of conductive pads on an undersurface thereof a rectangular insulative housing located under said plate;

a plurality of deflectively resilient terminals retainably disposed in the housing, each of said terminals defining an upper contact portion exposed above an upper face of the housing and downwardly deflectably engaged with the corresponding conductive pad when the plate and the housing are coupled to each other, some of said terminals having first portions, exclusive of second portions, defining corresponding upper contact portions while the remaining of said terminals having said second portions, exclusive of said first portions, defining corresponding upper contact portions, wherein downward deflection of the contact portion results in a horizontal resistant force component relative to the plate according to an extension direction of said contact portion from a top view of the housing, and the contact portions of said first portions of the terminals direct to a first extension direction while those of said second portions of the terminals direct to a second direction opposite to said first direction so as to counterbalance total horizontal resistant force components derived from said first portions and said second portions of the terminals, thus assuring said plate will not tend to move horizontally due to any horizontal resistant force components derived from the first portions and the second portions of the terminals, wherein the terminals are arranged in rows and columns perpendicular to each other, under a condition that the first and second directions extend along said columns, and the terminals having the first portions thereof and the terminals having the second portions are aligned with one another in said columns while mutually alternatively arranged with each other in said rows, wherein the first direction and the second direction are essentially diagonal with regard to the housing.

* * * * *